US010286521B2

(12) United States Patent
Hara et al.

(10) Patent No.: US 10,286,521 B2
(45) Date of Patent: May 14, 2019

(54) DRESSING APPARATUS AND DRESSING METHOD OF POLISHING PAD OF DOUBLE-SIDE POLISHING APPARATUS

(71) Applicant: Fujikoshi Machinery Corp., Nagano-shi, Nagano (JP)

(72) Inventors: Mitsuhiro Hara, Nagano (JP); Ryosuke Yoda, Nagano (JP)

(73) Assignee: FUJIKOSHI MACHINERY CORP., Nagano-Shi, Nagano (JP)

( * ) Notice: Subject to any disclaimer, the term of this patent is extended or adjusted under 35 U.S.C. 154(b) by 344 days.

(21) Appl. No.: 15/200,156

(22) Filed: Jul. 1, 2016

(65) Prior Publication Data

US 2017/0008147 A1 Jan. 12, 2017

(30) Foreign Application Priority Data

Jul. 8, 2015 (JP) ..... 2015-136682

(51) Int. Cl.
*B24B 53/017* (2012.01)

(52) U.S. Cl.
CPC ..... *B24B 53/017* (2013.01)

(58) Field of Classification Search
None
See application file for complete search history.

(56) References Cited

U.S. PATENT DOCUMENTS

| | | | | |
|---|---|---|---|---|
| 4,984,390 | A * | 1/1991 | Kobayashi | B24B 49/18 125/11.01 |
| 5,421,768 | A | 6/1995 | Fujiwara et al. | |
| 2002/0132559 | A1 * | 9/2002 | Togawa | B24B 37/30 451/8 |
| 2009/0104863 | A1 * | 4/2009 | Lin | B24B 53/017 451/443 |
| 2011/0312254 | A1 | 12/2011 | Koyama | |

FOREIGN PATENT DOCUMENTS

| | | | |
|---|---|---|---|
| JP | 7-9340 | A | 1/1995 |
| JP | 2012-741 | A | 1/2012 |

* cited by examiner

*Primary Examiner* — Joseph J Hail
*Assistant Examiner* — Brian D Keller
(74) *Attorney, Agent, or Firm* — Birch, Stewart, Kolasch & Birch, LLP

(57) ABSTRACT

To provide a dressing apparatus capable of uniformly dressing a polishing pad. The apparatus includes first and second dressing grind stones 51 and 52 which grind polishing pads 17 and 18 by moving in a radial direction of upper and lower polishing plates 12 and 14 while abutting on corresponding polishing pads 17 and 18, in which the first and second dressing grind stones 51 and 52 are set so as to have: an inner side region portion P; an outer side region portion Q; and an intermediate region portion R, wherein the length of each of the inner side region portion P and the outer side region portion Q extending in a circumferential direction of the polishing plates 12 and 14 is longer than the length of the intermediate region portion R extending in a circumferential direction of the polishing plates.

18 Claims, 11 Drawing Sheets

DRESSING APPARATUS AND DRESSING METHOD OF POLISHING PAD OF DOUBLE-SIDE POLISHING APPARATUS

CROSS-REFERENCE TO RELATED APPLICATION

This application is based upon and claims the benefit of priority of the prior Japanese Patent Application No. 2015-136682, filed on Jul. 8, 2015, and the entire contents of which are incorporated herein by reference.

FIELD

The present invention relates to a dressing apparatus and a dressing method of a polishing pad of a double-side polishing apparatus.

BACKGROUND

Polishing of a work such as a semiconductor wafer is performed by pressing in contact with a surface to be polished of the work to the surface of a polishing pad on a polishing plate to which the polishing pad is adhered, and by rotating the polishing plate while supplying a polishing liquid onto the polishing pad.

Then, after the completion of the polishing, polishing waste or the polishing liquid has infiltrated into the polishing pad to thereby lower a polishing rate, and thus, usually, high-pressure cleaning water is jetted to the polishing pad for each one batch of the polishing to thereby wash away the infiltrated polishing waste or the polishing liquid (Patent Literature 1). Furthermore, even when the polishing pad is cleaned for each one batch of the polishing, the polishing pad usually causes undulation (uneven surface) when performing polishing of as many as approximately seven batches, and a degree of flatness is lowered and a polishing rate is lowered.

Accordingly, a configuration is such that a carrier of a work is taken out from a polishing apparatus after performing polishing of approximately seven batches and instead, a ring-shaped correction grind stone provided with a gear is mounted and a dressing operation of grinding polishing pads of upper and lower polishing plates and of flattening the polishing pads is performed using the ring-shaped correction grind stone. Among four ring-shaped correction grind stones, the two correction grind stones are used for dressing the polishing pad of the lower polishing plate, and the other two ring-shaped correction grind stones are used for dressing the polishing pad of the upper polishing plate.

However, even when the polishing pad is cleaned by jetting high-pressure cleaning water for each one batch of polishing, an uneven surface is gradually generated in the polishing pad for each of batches, and the polishing rate of a work is lowered. In addition, although the polishing rate is restored by grinding and flattening the polishing pad through the use of a correction grind stone after polishing of seven batches, the polishing rate is not maintained constant and a degree of polishing is adjusted by polishing time, and thus there are problems in which the control is troublesome and accurate polishing is difficult to be performed. Furthermore, there is a problem in which the time of approximately 15 to 20 minutes on every occasion is required for replacing a carrier with a ring-shaped correction grind stone and of performing a dressing operation, after polishing of seven batches, and thus work efficiency is poor. Moreover, there is a problem in which a span of life of a polishing pad is also short since a dressing operation of grinding the polishing pad through the use of a correction grind stone every time after polishings of seven batches, is performed.

Accordingly, in Patent Literature 2, a configuration is such that, in place of a large ring-shaped correction grind stone, a small cuboid-shaped dressing grind stone is moved in the radial direction of upper and lower polishing plates at each completion of polishing of one batch and a dressing operation is performed on every occasion.

According to the method, there are advantages that, since a small dressing grind stone is used, the dressing grind stone can be moved in the radial direction by utilizing a gap between adjacent carriers and the dressing operation can be performed while the carrier is left mounted, and that, since the dressing operation is finely performed at each completion of polishing of one batch, the degree of flatness of the polishing pad can be maintained and thus highly accurate polishing can be performed.

CITATION LIST

Patent Literature

Patent Literature 1: Japanese Laid-Open Patent Publication No. H07-9340

Patent Literature 2: Japanese Laid-Open Patent Publication No. 2012-741

SUMMARY

Technical Problem

However, even the method described in Patent Literature 2 has become insufficient in terms of a request for maintaining higher polishing accuracy.

The present invention has been made in order to solve the above-described problem and an object thereof is to provide a dressing apparatus and a dressing method of a polishing pad of a double-side polishing apparatus, in which the apparatus and the method shown in Patent Literature 2 are further improved.

Solution to Problem

In order to achieve the above-described purpose, the present invention includes a following configuration.

Namely, the dressing apparatus according to the present invention is a dressing apparatus of a polishing pad of a double-side polishing apparatus for dressing both polishing pads of upper and lower polishing plates, in the double-side polishing apparatus including: the ring-shaped lower polishing plate having the polishing pad fixed on an upper surface and being provided rotatably centering on a rotary shaft; the ring-shaped upper polishing plate having the polishing pad fixed on a lower surface and being provided vertically movably above the lower polishing plate and rotatably centering on a rotary shaft; a sun gear disposed at a center of the lower polishing plate; an internal gear disposed while surrounding the lower polishing plate; a carrier that is disposed between the lower polishing plate and the upper polishing plate, has a through-hole for holding a work and revolves around the sun gear and rotates on its axis while meshing with the sun gear and the internal gear; and a slurry supply mechanism for supplying slurry to the polishing pad, the dressing apparatus including: an arm member provided so as to enter between the upper and lower polishing plates and be capable of going straight or swinging in an arc shape centering on a rotary shaft; a supporting member provided at a tip part of the arm member; first and second dressing grind stones which are provided on the upper surface side and the lower surface side of the supporting member, respectively, and which move in a radial direction of the upper and lower polishing plates while abutting on the corresponding polishing pad surfaces as a result of the fact that the arm member goes straight or swings in an arc shape as described above, to thereby grind the corresponding polishing pads, wherein each of the first and second dressing grind stones has: an inner side region portion which is positioned on an inner edge side of the upper and lower polishing plates when moving in an inner edge direction of the upper and lower polishing plates and which extends by a required length in a radial direction of the upper and lower polishing plates; an outer side region portion which is positioned on an outer edge side of the upper and lower polishing plates when moving in an outer edge direction of the upper and lower polishing plates and which extends by a required length in a radial direction of the upper and lower polishing plates; and an intermediate region portion which is positioned between the inner side region portion and the outer side region portion and which extends by a required length in a radial direction of the upper and lower polishing plates, and wherein the length of each of the inner side region portion and the outer side region portion extending in a circumferential direction of the upper and lower polishing plates is set so as to become longer than the length of the intermediate region portion extending in a circumferential direction of the upper and lower polishing plates.

The supporting member is suitably provided with a nozzle unit that jets cleaning water to the respective polishing pads of the upper and lower polishing plates.

Suitably, the inner side region portions of the first and second dressing grind stones are formed into a shape that follow the inner edge of the upper and lower polishing plates, and the outer side region portions are formed into a shape that follow the outer edge of the upper and lower polishing plates.

The inner side region portion, the intermediate region portion and the outer side region portion of each of the first and second dressing grind stones can form a deformed H shape.

A spherical seat part is suitably provided on the upper surface side and the lower surface side of the supporting member, and each of the first and second dressing grind stones is tiltably supported by the spherical seat part.

Suitably, first and second airbags are provided between the first and second dressing grind stones and the supporting member, respectively, and compressed air is supplied to the first and second airbags, to thereby give pressing force by air onto the first and second dressing grind stones.

In this case, air supply portions independently supplying compressed air to each of the first and second airbags can be provided.

Each of the first and second dressing grind stones can also be guided in a direction contacting/separating to/from the supporting member via a guide shaft inserted into the supporting member.

In addition, the dressing method according to the present invention includes: by using any of the above-described dressing apparatus of a polishing pad of the double-side polishing apparatus, rotating the upper and lower polishing plates of a double-side polishing apparatus; causing the arm member to enter between the upper and lower polishing plates and causing the arm member to go straight or swing in an arc shape to thereby move the first and second dressing grind stones in a radial direction of the upper and lower polishing plates; and grinding the polishing pad so as to give approximately uniform thickness, including the inner edge side and the outer edge side of the polishing pad, to thereby perform a dressing operation of the polishing pad.

The dressing method may include cleaning the polishing pad by jetting out cleaning water to the polishing pad from the nozzle unit, in parallel with the dressing operation of the polishing pad or after the dressing operation of the polishing pad.

The dressing method suitably includes: removing only one of the plurality of carriers mounted on the double-side polishing apparatus; and moving the first and second dressing grind stones in a radial direction of the upper and lower polishing plates in a region of an exposed polishing pad, to thereby perform the dressing operation of the polishing pad.

A grinding amount can be adjusted in such a manner that a rotation frequency of the upper and lower polishing plates when the first and second dressing grind stones are positioned on a center side of the upper and lower polishing plates is set to be greater than a rotation frequency of the upper and lower polishing plates when the first and second dressing grind stones are positioned on an outer circumference side of the upper and lower polishing plates.

Furthermore, a grinding amount can be adjusted in such a manner that a staying time of the first and second dressing grind stones when the first and second dressing grind stones are positioned on a center side of the upper and lower polishing plates is set to be longer than a staying time of the first and second dressing grind stones when the first and second dressing grind stones are positioned on an outer circumference side of the upper and lower polishing plates.

Moreover, a grinding amount can be adjusted in such a manner that pressing force onto the polishing pad by the first and second dressing grind stones when the first and second dressing grind stones are positioned on a center side of the upper and lower polishing plates is set to be larger than pressing force onto the polishing pad by the first and second dressing grind stones when the first and second dressing grind stones are positioned on an outer circumference side of the upper and lower polishing plates.

Advantageous Effects of Invention

According to the present invention, a dressing apparatus and a dressing method, which can uniformly perform dressing of an entire polishing pad including an inner circumference portion and an outer circumference portion, can be provided.

DESCRIPTION OF THE PREFERRED EMBODIMENTS

Hereinafter, suitable embodiments of the present invention will be explained in detail on the basis of the attached drawings.

First, an example of a double-side polishing apparatus will be explained.

Figure 1:
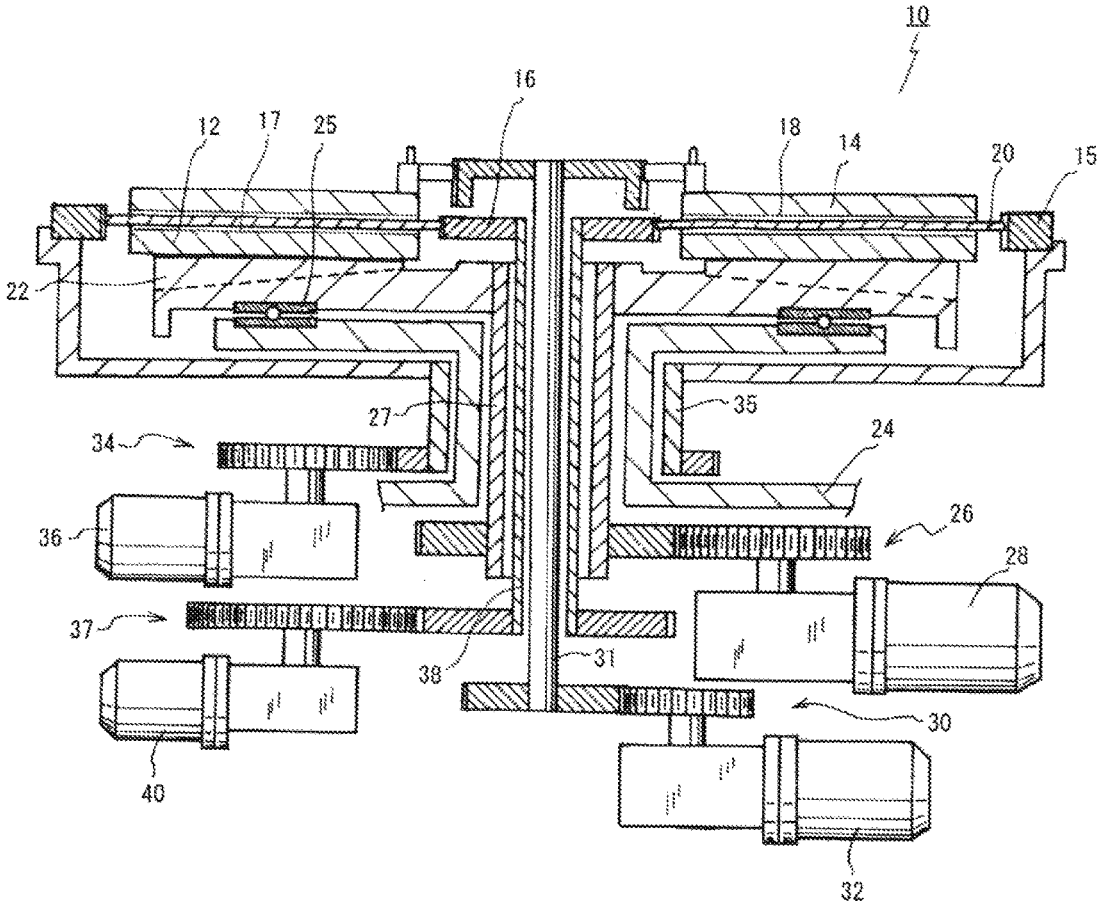
FIG. 1 is a cross-sectional view showing an example of a double-side polishing apparatus.
Figure 2:
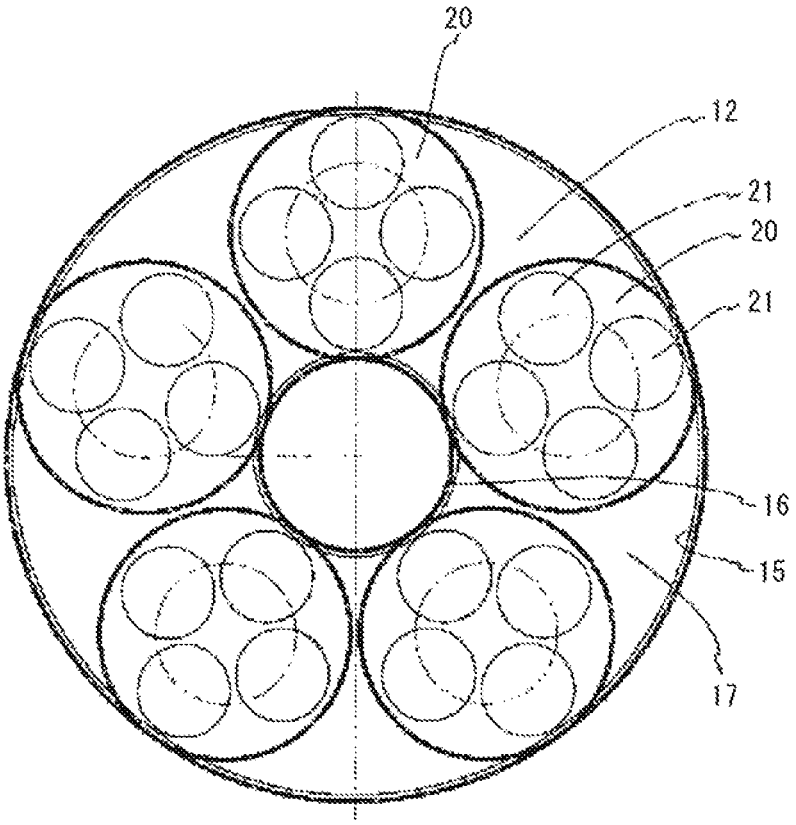
FIG. 2 is a plan view for explaining a carrier.

FIG. 1 is a cross-sectional view of a double-side polishing apparatus 10 that polishes a work such as a silicon wafer. FIG. 2 is a plan view showing the relationship between a lower polishing plate and a carrier thereof.

In the apparatus shown in FIG. 1, a carrier 20 driven by an internal gear 15 and a sun gear 16 is disposed between a lower polishing plate 12 and an upper polishing plate 14 which are rotated in a direction opposite to each other.

Polishing pads 17 and 18 are adhered, respectively, to the upper surface of the lower polishing plate 12 and to the lower surface of the upper polishing plate 14.

A through-hole 21 that supports a work to be polished is bored in the carrier 20, and the both surfaces of the work supported by the through-hole 21 are polished at the same time by the lower polishing plate 12 and the upper polishing plate 14.

The lower polishing plate 12 shown in FIG. 1 is placed on a polishing plate receiver 22, and is rotated by the rotation of the polishing plate receiver 22. The polishing plate receiver 22 is placed rotatably on a base 24 via a bearing 25, and is rotated by rotational force from an electric motor 28 transmitted via a driving force transmitting gear 26 and a cylindrical shaft 27.

In addition, the upper polishing plate 14 is rotated by rotational force of an electric motor 32 via a driving force transmitting gear 30 and a shaft 31.

The internal gear 15 is rotated by rotational force of an electric motor 36 via a driving force transmitting gear 34 and a cylindrical shaft 35.

Furthermore, the sun gear 16 is also rotated by rotational force from an electric motor 40 via a driving force transmitting gear 37 and a cylindrical shaft 38.

Note that, in FIG. 2, each of the carriers 20 has four through-holes 21, and works are accommodated, respectively, in the four through-holes 21, but the number of the through-hole 21 and the work may be freely set in consideration of the size of the work.

Next, a dressing apparatus 42 will be explained.

Figure 3:
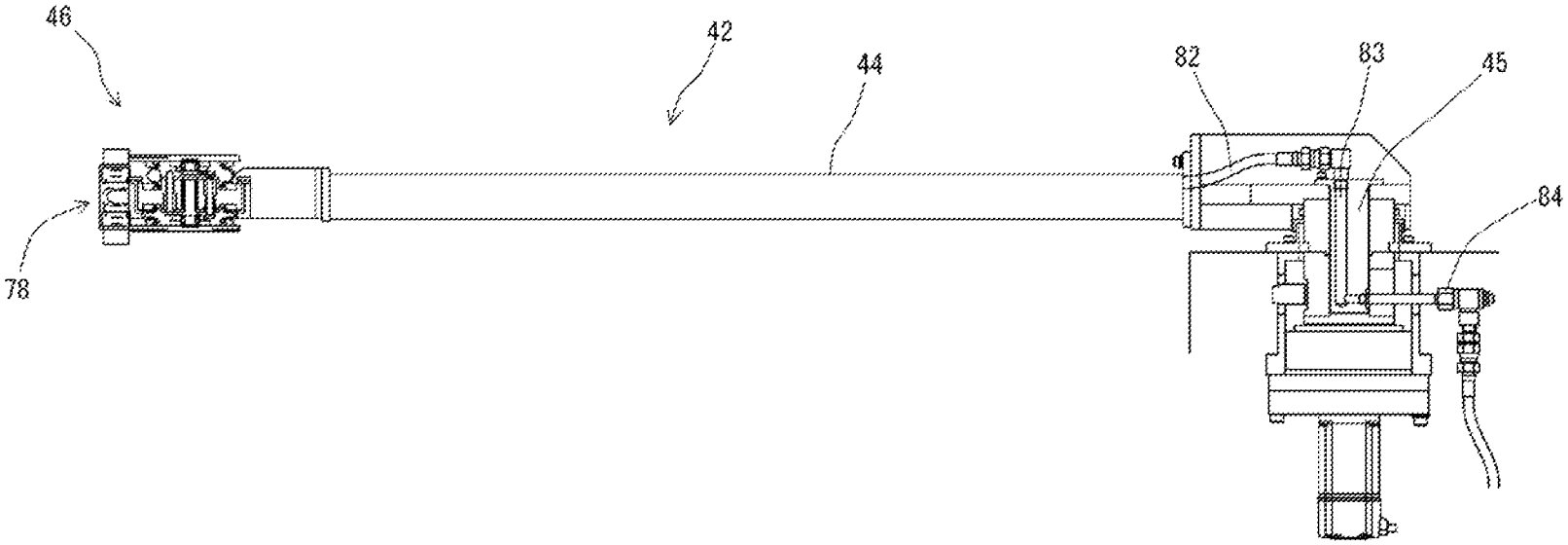
FIG. 3 is a front cross-sectional view of a dressing apparatus.
Figure 4:
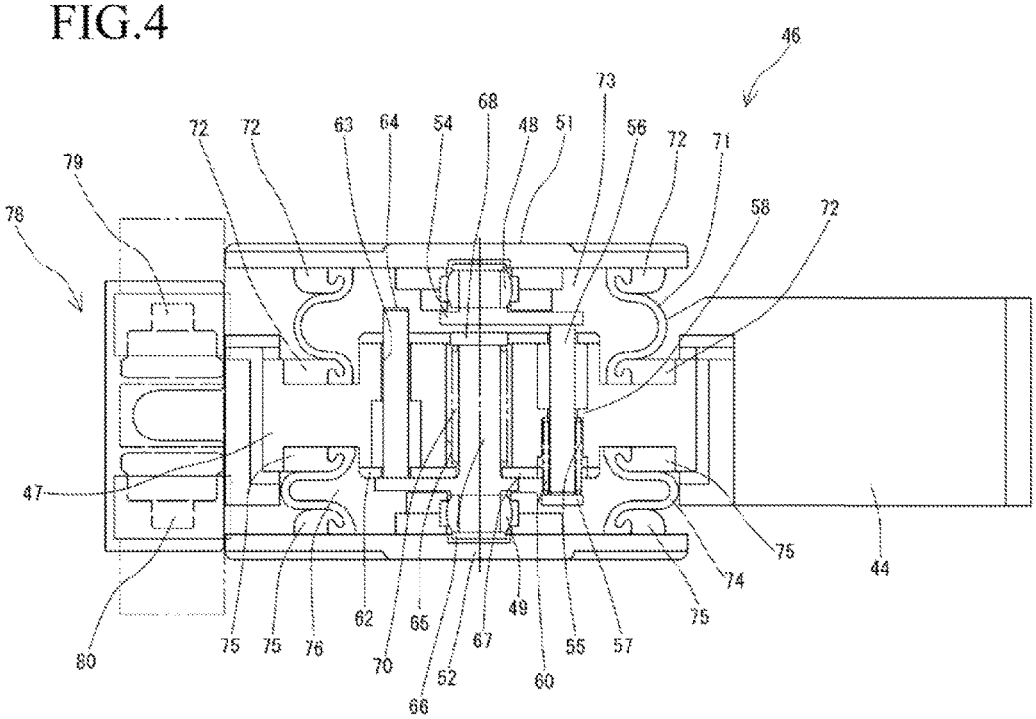
FIG. 4 is an enlarged cross-sectional view of a head part of a dressing apparatus.
Figure 5A:
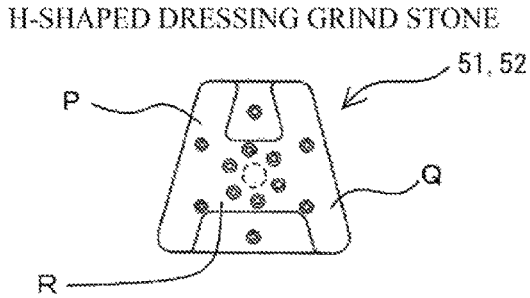
FIGS. 5A and 5B are, respectively, a plan view of the dressing grind stone according to the present embodiment, and a schematic view showing a degree of flatness of a polishing pad when the dressing grind stone is used.
Figure 6:
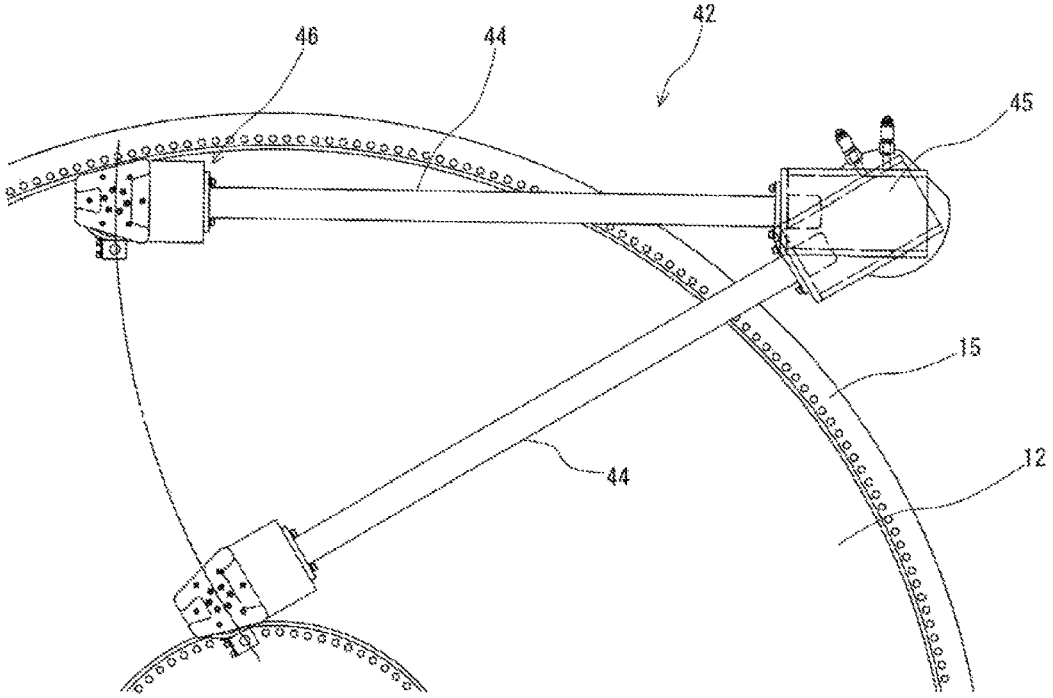
FIG. 6 is a plan view of a dressing apparatus.

FIG. 3 is a front cross-sectional view of the dressing apparatus 42, FIG. 4 is a partially enlarged view thereof, FIG. 5A is a plan view of a dressing grind stone, and FIG. 6 is a plan view of the dressing apparatus 42.

The reference numeral 44 denotes an arm member, which is provided in a hollow state, and is turnably provided in an arc shape (fan-like shape) in a horizontal plane centering on a rotary shaft 45 positioned outside the polishing plates 12 and 14.

A head part 46 is attached to the tip part of the arm member 44.

The arm member 44 is turnably positioned outside the upper and lower polishing plates 12 and 14, except for the time of a dressing operation. Then, at the time of a dressing operation, the arm member 44 is turned so as to be positioned in the upper and lower polishing plates 12 and 14, and is caused to perform the dressing operation of the polishing pads 17 and 18 of the upper and lower polishing plates 12 and 14 by the dressing grind stone provided at the head part 46. Note that the turning of the arm member 44 can be performed with a not shown servomotor or the like.

The head part 46 has a supporting member 47 directly fixed to the tip of the arm member 44, and a first dressing grind stone 51 and a second dressing grind stone 52 tiltably supported on the upper surface and lower surface sides of the supporting member 47 via spherical seat parts 48 and 49, respectively, in a horizontal plane.

As shown in FIG. 4, the spherical seat part 48 is provided on the upper surface of a supporting plate 54, and a guide shaft 56 inserted through a through-hole 55 provided in the supporting member 47 is attached to the supporting plate 54. In addition, a coil spring 60 is inserted between a flange 57 provided at the lower end of the guide shaft 56 and a projection part 58 provided at a middle portion of the inner wall of the through-hole 55, and the first dressing grind stone 51 is urged by urging force of the coil spring 60 in the lower direction in FIG. 4.

On the other hand, the spherical seat part 49 is provided on the lower surface of a supporting plate 62, and a guide shaft 64 inserted through a through-hole 63 provided in the supporting member 47 is attached to the supporting plate 62. Furthermore, the supporting plate 62 is provided with a shaft 66 entering a through-hole 65 passing through the supporting member 47. Additionally, a coil spring 70 is inserted between a projection part 67 provided to be projected toward the inside at the lower end of the through-hole 65, and a flange 68 provided at the upper end of the shaft 66, and the second dressing grind stone 52 is urged by urging force of the coil spring 70 in the upper direction in FIG. 4.

The reference numeral 71 denotes a cylindrical member made from rubber, and is fixed between the lower surface of the first dressing grind stone 51 and the upper surface of the supporting member 47 by using a fixing part 72, to thereby form a first air chamber 73 between the lower surface of the first dressing grind stone 51 and the upper surface of the supporting member 47. The cylindrical member 71, the first air chamber 73 and the like constitute a first airbag.

In addition, the reference numeral 74 also denotes a cylindrical member made from rubber, and is fixed between the upper surface of the second dressing grind stone 52 and the lower surface of the supporting member 47 by using a fixing part 75, to thereby form a second air chamber 76 between the upper surface of the second dressing grind stone 52 and the lower surface of the supporting member 47. The cylindrical member 74, the second air chamber 76 and the like constitute a second airbag.

Compressed air is supplied to the inside of the first air chamber 73 and to the inside of the second air chamber 76, by an air hose (not shown) extending through the inside of the hollow arm member 44. The air hose is connected to a not shown air supply source via an air pathway (not shown) inside the rotary shaft 45, and furthermore, a rotary joint (not shown) leading to the air pathway.

The first dressing grind stone 51 can be urged toward the upper side against the urging force of the coil spring 60, by supplying compressed air to the inside of the first air chamber 73.

In the same way, the second dressing grind stone 52 can be urged toward the lower side against the urging force of the coil spring 70, by supplying compressed air to the inside of the second air chamber 76.

Note that, in the above description, compressed air is set to be supplied independently to the inside of the first air chamber 73 and to the inside of the second air chamber 76, the first air chamber 73 and the second air chamber 76 may be provided in a communicated state, and thus compressed air may be supplied to both chambers from one air circuit.

The tip part of the supporting member 47 is provided with a nozzle unit 78.

The nozzle unit 78 is provided with a nozzle 79 that jets cleaning water toward the upper side and a nozzle 80 that jets cleaning water toward the lower side. Nozzles 79 and 80 are connected to a not shown water source via a flow path extending to the inside of the nozzle main body (not shown), a flow path provided in the inside of the supporting member 47 (not shown), a flow path 82 extending to the inside of the arm member 44, a flow path 83 extending to the inside of the rotary shaft 45, and a rotary joint 84.

Note that, since a rotation mechanism centering on the rotary shaft 45 of the arm member 44 may be a known one, the explanation is omitted in particular.

FIG. 5A is a plan view of each of the first dressing grind stone 51 and the second dressing grind stone 52. FIG. 6 is a plan view of the dressing apparatus 42.

Figure 7:
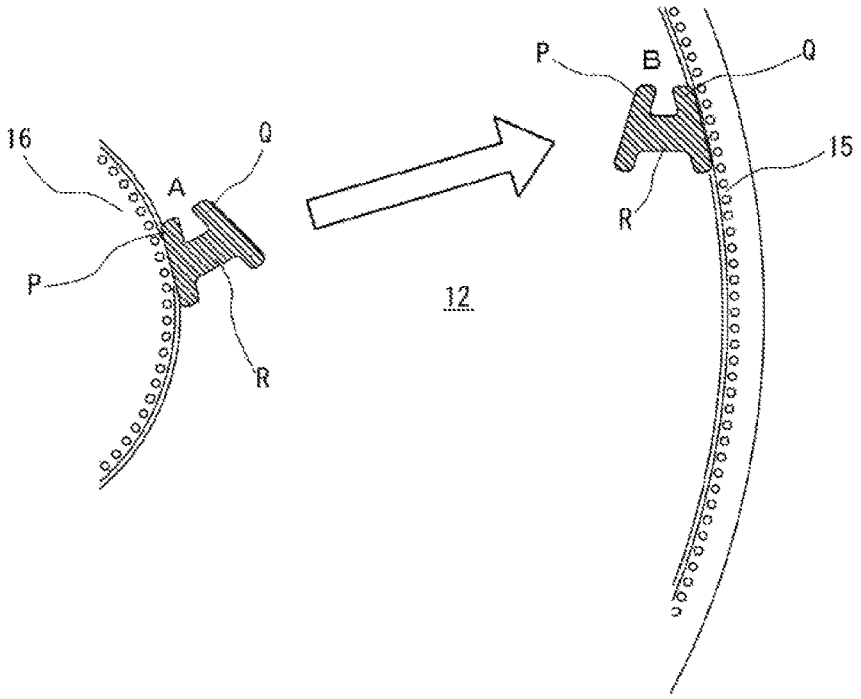
FIG. 7 is an explanatory view of a case where the dressing grind stone positioned on the polishing pad inner circumference side, or the outer circumference side.

As shown in FIGS. 5 to 7, first and second dressing grind stones 51 and 52 are set so as to have: an inner side region portion P which is positioned on the inner edge side of the upper and lower polishing plates 12 and 14 when having moved in an inner edge direction of the upper and lower polishing plates 12 and 14 (A position in FIG. 7) and which extends by a required length in a radial direction of the upper and lower polishing plates; an outer side region portion Q which is positioned on the outer edge side of the upper and lower polishing plates 12 and 14 when having moved in an outer edge direction of the upper and lower polishing plates 12 and 14 (B position in FIG. 7) and which extends by a required length in a radial direction of the upper and lower polishing plates; and an intermediate region portion R which is positioned between the inner side region portion P and the outer side region portion Q and which extends by a required length in a radial direction of the upper and lower polishing plates, wherein the length of each of the inner side region portion P and the outer side region portion Q extending in a circumferential direction of the upper and lower polishing plates 12 and 14 is longer than the length of the intermediate region portion R extending in a circumferential direction of the upper and lower polishing plates 12 and 14.

Note that, as shown in FIGS. 6 and 7 and the like, the first and second dressing grind stones 51 and 52 are sufficiently smaller than the diameter of the upper and lower polishing plates 12 and 14. The first and second dressing grind stones 51 and 52 can grind and dress the entire surface of the polishing pads 17 and 18 by being moved in a radial direction of the upper and lower polishing plates 12 and 14, and by the rotation of the upper and lower polishing plates 12 and 14.

As shown in FIG. 5A, concretely, the first and second dressing grind stones 51 and 52 according to the present embodiment have a deformed H shape, in which one side is narrowed and the other side is broadened in planar view.

Note that the inner side region portions P of the first and second dressing grind stones 51 and 52 are suitably formed into a shape that follows the inner edge of the upper and lower polishing plates 12 and 14 (for example, arc-like shape), and also the outer side region portions Q are suitably formed into a shape that follows the outer edge of the upper and lower polishing plates 12 and 14 (for example, arc-like shape). Alternatively, as shown in FIG. 5A, both inner side region portion P and outer side region portion Q may extend by a required width, in a straight line shape.

Furthermore, the inner side region portion P, the intermediate region portion R, and the outer side region portion Q may not be formed into a deformed H shape, but may be in a U shape having a required width as a whole.

The dressing apparatus 42 according to the present embodiment is constituted as described above.

Next, a dressing method of a polishing pad by using the dressing apparatus 42 after the completion of polishing of a work will be explained.

Figure 8:
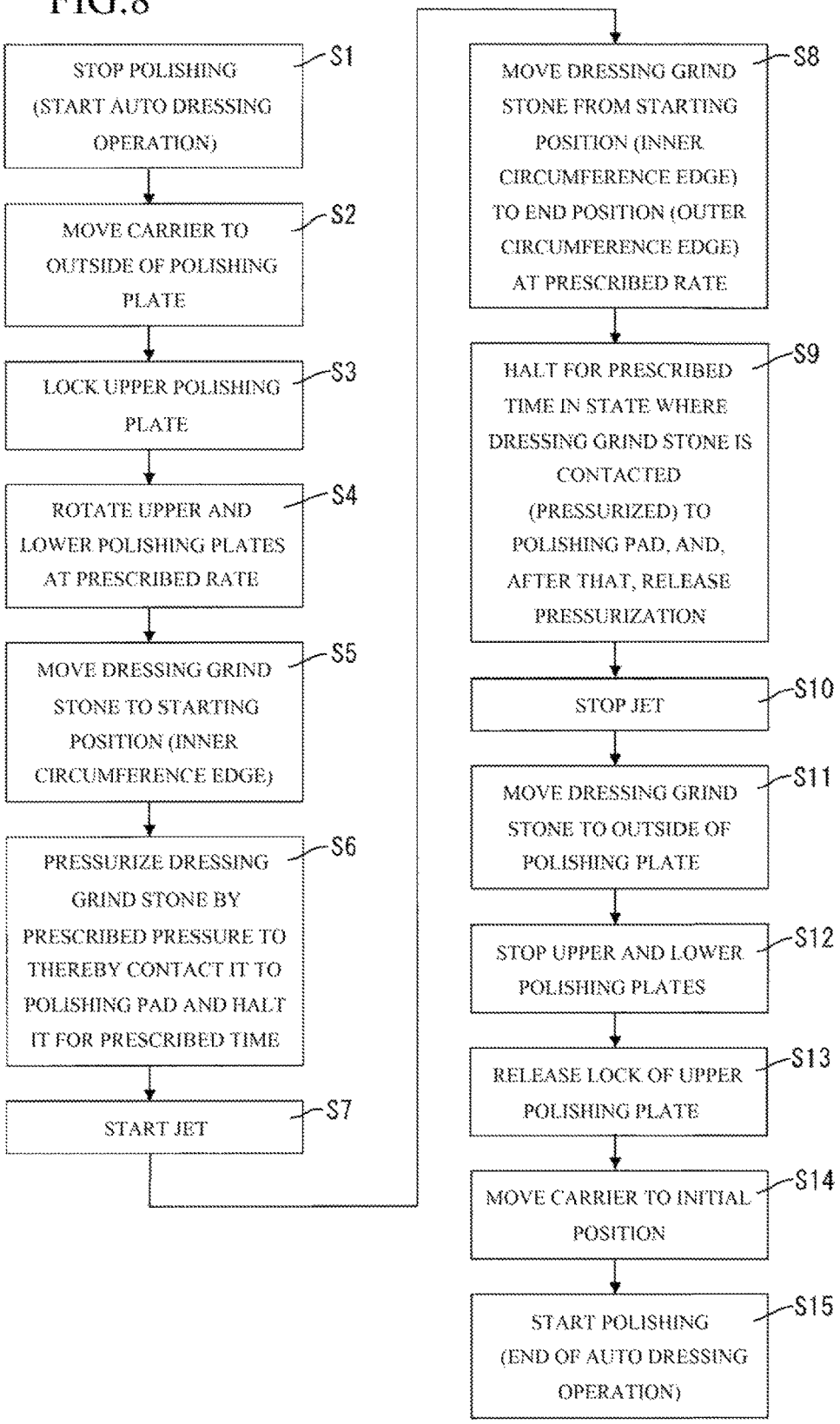
FIG. 8 is a flow chart of a dressing process.

FIG. 8 shows an operation flow when performing a dressing operation.

First, when polishing of a work is completed, the polishing of the work is stopped (Step 1: S1).

Figure 9:
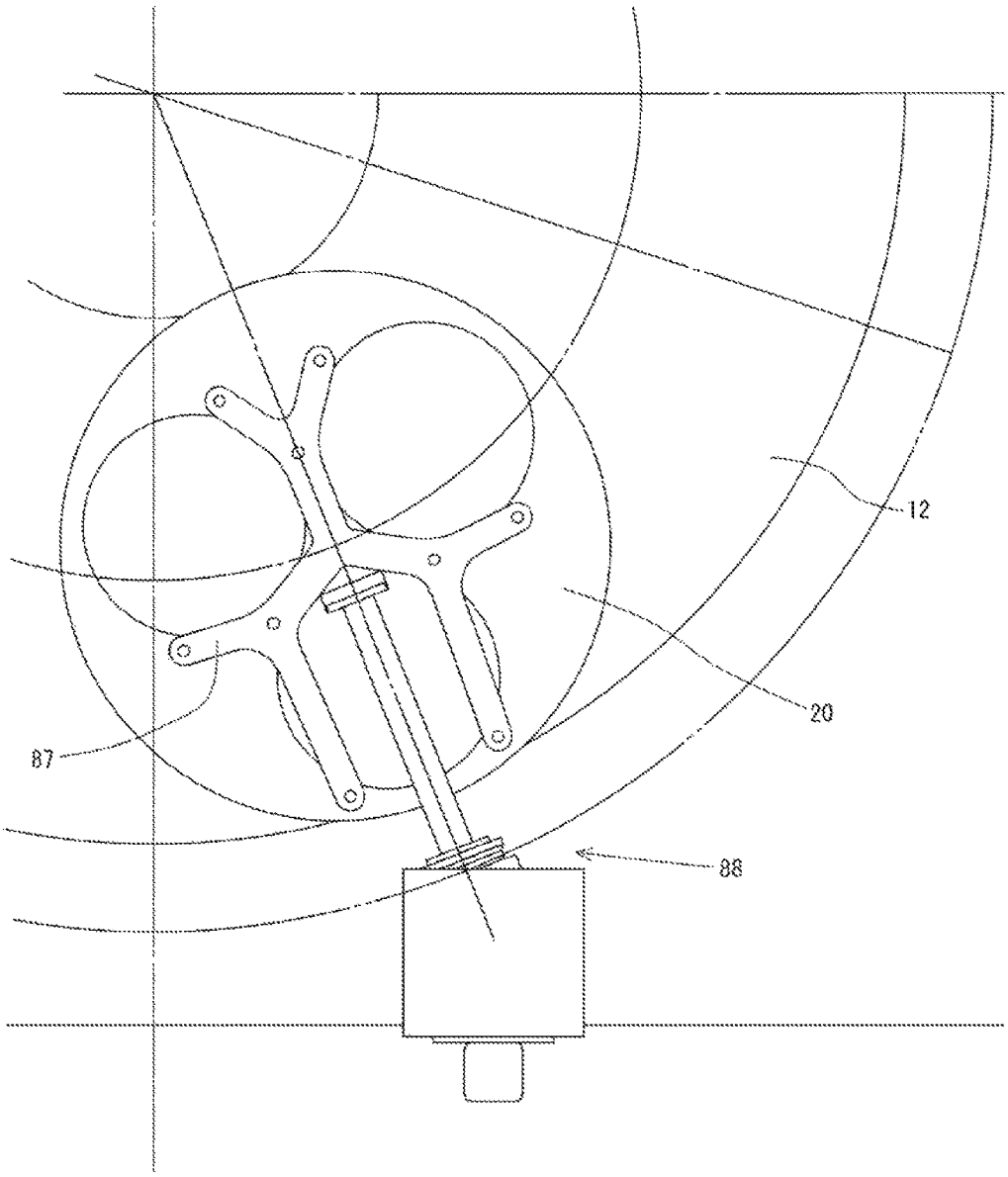
FIG. 9 is a plan view of a chucking unit.

Then, the carrier 20 at a site the arm member 44 enters is detached from the polishing plate (S2), among a plurality of carriers 20. The detachment of the carrier 20 can be performed by a chucking unit 88 having an adsorbing part 87, as shown in FIG. 9. The reason why one carrier 20 is detached is that a space for enabling swing of the arm member 44 is secured.

Subsequently, the upper polishing plate 14 is locked by using a not shown locking device, and thus the upper polishing plate 14 does not swing in the vertical direction relative to the horizontal plane (does not wave) (S3). A device having a mechanism of holding the upper surface of the upper polishing plate 14 can be adopted as the locking device.

After that, the upper and lower polishing plates 12 and 14 are rotated at a prescribed rate, for example, at 20 rpm (S4).

Next, a dressing operation is started (S5). Namely, the arm member 44 is turned to thereby enter between the upper and lower polishing plates 12 and 14, and the head part 46 is caused to be positioned at an inner edge portion (inner circumference edge) of the upper and lower polishing plates 12 and 14.

Then, the dressing grind stones 51 and 52 are abutted on the polishing pads 17 and 18 at a prescribed pressure (S6). Namely, the upper polishing plate 14 is lowered to a required position, and compressed air is supplied to the inside of the first air chamber 73 and the second air chamber 76 to thereby pressurize the first and second dressing grind stones 51 and 52.

Subsequently, cleaning water is jetted onto upper and lower polishing pads from the nozzle unit 78 (S7).

The head part 46 may be caused to stop and stay for a required time, at the start of the dressing operation, to thereby sufficiently grind the inner circumference side of the polishing pad.

Next, the arm member 44 is turned so that the head part 46 is moved in a radial direction of the upper and lower polishing plates 12 and 14 up to the outer edge portion (outer circumference edge) being a completion position of the dressing operation (S8). A swing rate of the arm member 44 in this case is set to be, for example, 0.2 d/sec. The head part 46 may be caused to stop and stay at the outer circumference edge for a required time, to thereby sufficiently grind the outer circumference side of the polishing pad (S9).

In this way, the dressing operation is completed.

Then, jetting of cleaning water from the nozzle unit 78 is stopped (S10).

Furthermore, the arm member 44 is turned, and is moved outward from between the upper and lower polishing plates 12 and 14 (S11).

Subsequently, the rotation of the upper and lower polishing plates 12 and 14 is stopped (S12).

After that, the upper polishing plate 14 is unlocked (S13).

Next, the carrier 20 is adsorbed by the chucking unit 88 and is moved to the initial position (S14).

Then, polishing of the subsequent batch of the work is started (end of dressing operation) (S15).

The dressing operation of a polishing pad is suitably performed after each completion of one batch of polishing, but may appropriately be selected depending on the situation, such as after each completion of two batches.

Furthermore, a correction dressing operation for grinding a polishing pad may be performed using a conventional large ring-shaped correction grind stone after, for example, the completion of 20 batches.

In the present embodiment, in the first and second dressing grind stones 51 and 52, the length of each of the inner side region portion P and the outer side region portion Q in the polishing plate circumferential direction, which corresponds to the inner edge side and outer edge side of a polishing pad where grinding tends to be insufficient, is set to be longer than the length of the intermediate region portion R, and thus the contact area of the site can be made larger, with the result that uniform grinding becomes possible for the entire polishing pad.

In addition, as described above, at the start of a dressing operation, the head part 46 is positioned on the inner circumference side having a slow peripheral velocity, and thus the staying time of the head part 46 may be made long (for example, 6 seconds corresponding to two circumferential rounds of polishing plate) or rotation frequencies of the upper and lower polishing plates 12 and 14 may be made rapid. Alternatively, the pressurization force to the polishing pad by the dressing grind stones 51 and 52 is made strong. On the other hand, at the completion of a dressing operation, the head part 46 is positioned on the outer circumference side having a rapid peripheral velocity, and thus, the staying time of the head part 46 may be made short (for example, three seconds per one round of polishing plate) or the rotation frequency of the upper and lower polishing plates 12 and 14 may be made slow. Alternatively, the pressurization force to the polishing pad by the dressing grind stones 51 and 52 may be made weak. Grinding and dressing operation can be further favorably performed on both the inner edge side and outer edge side of the polishing pad, by performing various adjustments in this way.

Figure 10:
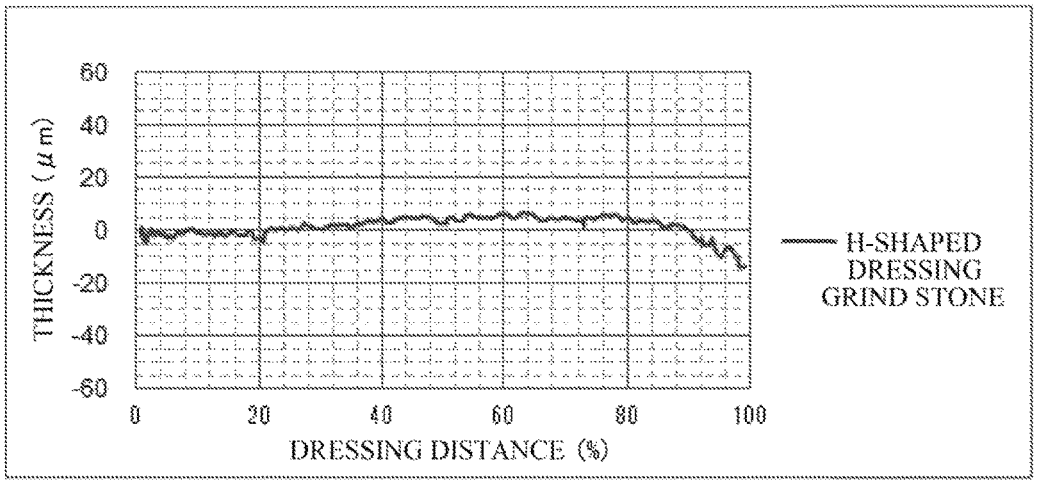
FIG. 10 is a graph showing a degree of flatness of a polishing pad (thickness of a polishing pad from the surface of a polishing plate) after a dressing operation.
Figure 11:
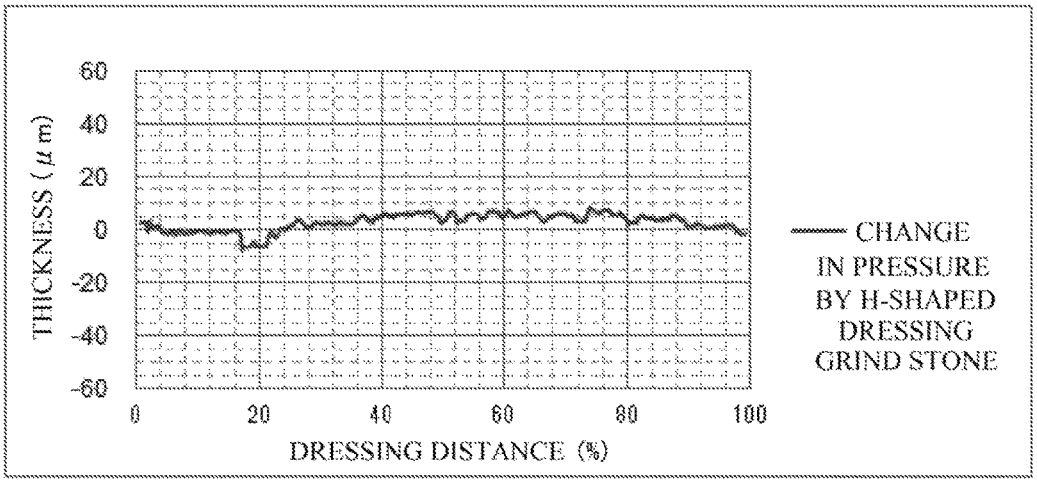
FIG. 11 is a graph showing a degree of flatness of a polishing pad when pressurization force by a dressing grind stone is adjusted.

FIG. 10 is a graph showing the degree of flatness of a polishing pad after performing a dressing operation by using the above-described dressing grind stones 51 and 52 (thickness of the polishing pad from the surface of a polishing plate, in a dressing distance from the inner circumference side to the outer circumference side). Although the outer circumference side (100% side of the dressing distance) is slightly overly ground, it is approximately flat. FIG. 11 is a graph showing a case where the pressurization force by the dressing grind stones 51 and 52 is adjusted by using an airbag. Dressing excellent in the degree of flatness became possible, as the result of adjusting the pressurization force on the outer circumference side (100% side of the dressing distance) so as to be slightly reduced.

Figure 12:
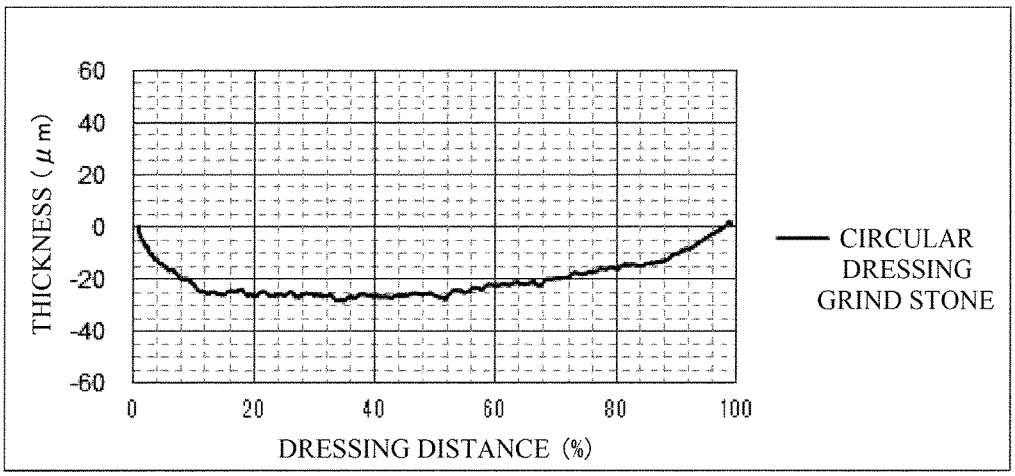
FIG.12 Prior Art
FIG. 12 is a graph showing a degree of flatness of a polishing pad when a circular dressing grind stone is used.
Figure 13A:
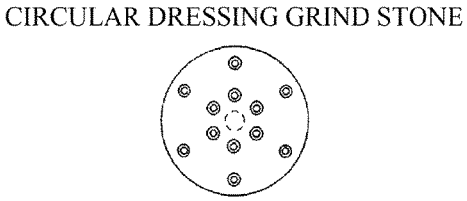
FIG.13A Prior Art
FIGS. 13A and 13B are, respectively, an explanatory view of a circular dressing grind stone, and a schematic view showing a degree of flatness of a polishing pad when the dressing grind stone is used.

Note that FIG. 12 is a graph showing, as a reference example, the degree of flatness of a polishing pad when performing a dressing operation by using a circular dressing grind stone shown in FIG. 13A. It is known that the outer circumference side (100% side of dressing distance) and the inner circumference side (0% side of dressing distance) of the polishing pad are thick, and that grinding amounts on the outer circumference side and the inner circumference side are insufficient.

Figure 13B:
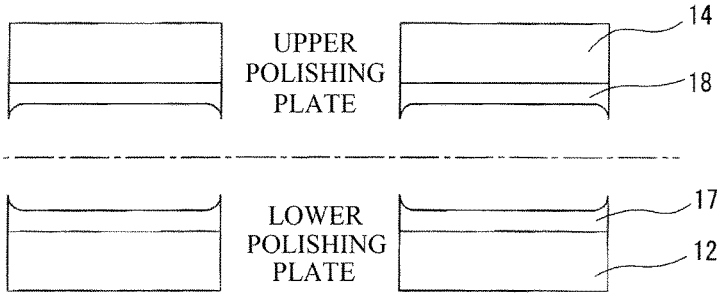
FIG.13B Prior Art

Dressing situations of polishing pads of the upper and lower polishing plates in a case of using a circular dressing grind stone are shown in a schematic view in FIG. 13B. As shown in the drawing, in a case of a circular dressing grind stone, the dressing operation on the inner circumference side and the outer circumference side of the polishing pads is insufficient. The reason is that the contact area between the dressing grind stone and the polishing pad on the inner circumference side and the outer circumference side of the polishing pad becomes small, since the dressing grind stone is circular. Namely, in a case of a circular dressing grind stone, there is generated a problem in which the dressing grind stone does not abut on the polishing pad near the internal gear and the sun gear to thereby not grind the polishing pad. The state where the polishing pad near the gears is not ground as described above and is projected deteriorates polishing accuracy in polishing of a work, thereby being not preferable.

Figure 14A:
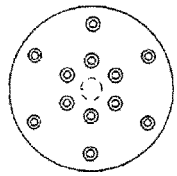
FIG.14A Prior Art
FIGS. 14A and 14B are, respectively, a view of a circular dressing grind stone, and a schematic view showing a degree of flatness of a polishing pad when performing a dressing operation while overlapping the circular dressing grind stone with the inner edge portion or the outer edge portion of a polishing pad.
Figure 14B:
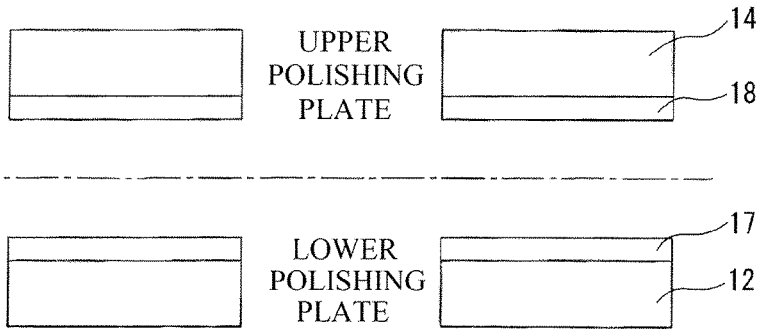
FIG.14B Prior Art

FIGS. 14A and 14B show a case of using a circular dressing grind stone in the same way, and also shows a result of performing a dressing operation in such a manner that: the sun gear 16 and the internal gear 15 are lowered to be lower than the upper surface of the lower polishing plate 12 so that the sun gear 16 and the internal gear 15 are not obstructive; and a part of the circular dressing grind stone projects more outward than the inner edge and the outer edge of the polishing pad (so as to overlap). As a result, the contact area between the circular dressing grind stone and the inner edge portion or outer edge portion of the polishing pad became larger, and thus a dressing operation giving a high (good) degree of flatness became possible. However, lowering of the sun gear 16 and the internal gear 15 toward a lower side every time is not preferable in terms of work efficiency.

In this respect, in a case of the present embodiment, as a result of devising the shape of the dressing grind stones 51 and 52 as described above, the contact area between the dressing grind stone and the inner edge portion or the outer edge portion of a polishing pad can be made larger without lowering the internal gear and the sun gear, thereby allowing a dressing operation of a high degree of flatness.

Figure 5B:
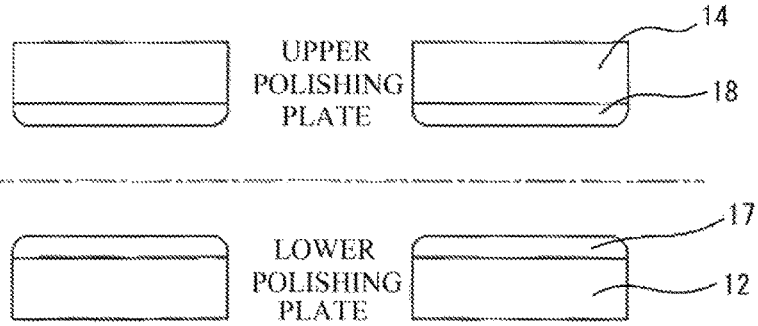

FIG. 5B is a schematic view showing a dressing situation of a polishing pad when a dressing operation was performed using the above deformed H-shaped dressing grind stone of the present embodiment. As is clear from the drawing, rather, grinding amounts on the inner circumference side and the outer circumference side of the polishing pad become greater. However, in this way, even when a polishing pad near a gear is excessively ground to thereby be in a lowly sunken state as described above, the sunken portion scarcely makes trouble at the time of polishing work if the state is not excessive, and also scarcely causes a problem. Furthermore, this point can be corrected, as described above, by adjusting the rotation frequency of the polishing plate in dressing the inner circumference side or the outer circumference side of a polishing pad, or by adjusting the staying time of the head part (dressing grind stone), or by adjusting the pressurization force by a dressing grind stone. Namely, the adjustment becomes easier when setting situations in FIG. 5B as a design center than setting situations in FIG. 13B as a design center.

Figure 15A:
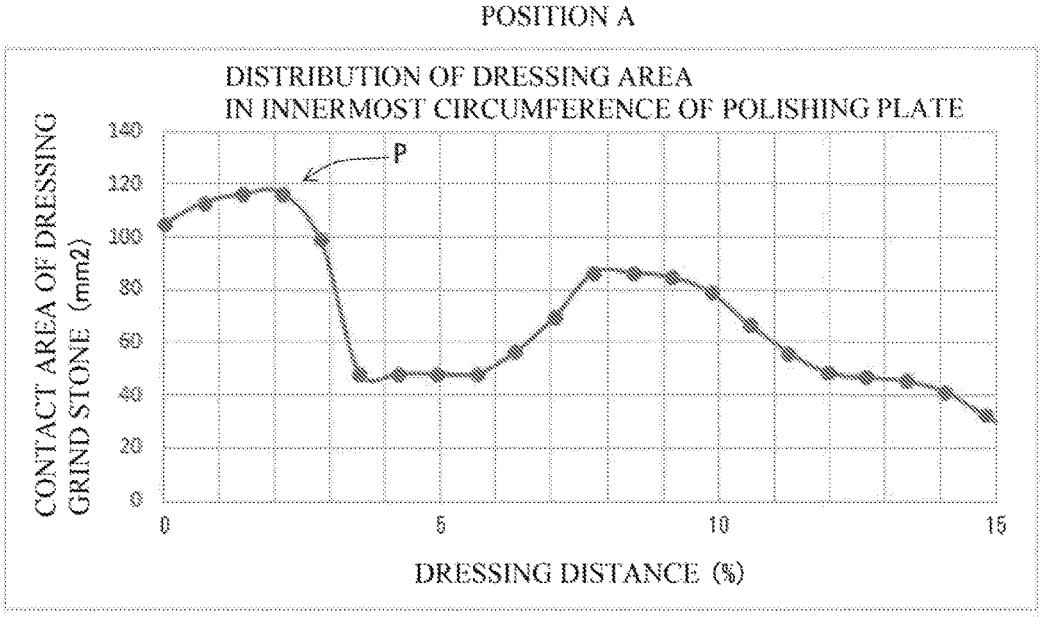
FIGS. 15A and 15B are graphs showing calculation results of contact areas between a polishing pad and a dressing grind stone.
Figure 15B:
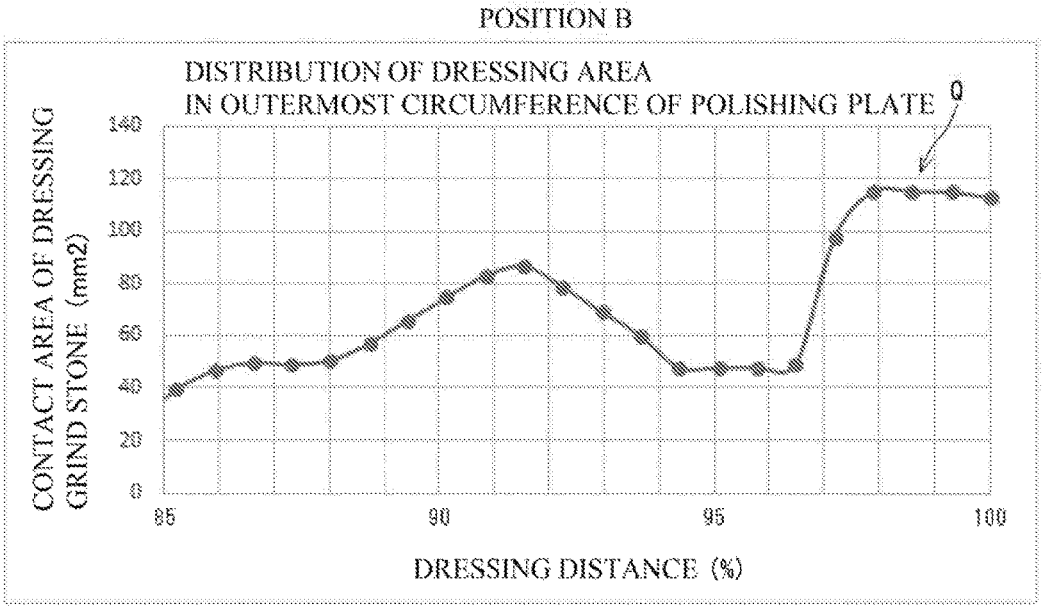

FIGS. 15A and 15B are graphs showing calculation results of contact areas between the polishing pad and the dressing grind stone when the dressing grind stone in the present embodiment is positioned at the position A or the position B in FIG. 7. As shown in the drawings, at the position A, the contact area of the inner side region portion P becomes larger, and at the position B, the contact area of the outer side region portion Q becomes larger. As described above, as a result of devising the shape of the dressing grind stone, the contact areas between the dressing grind stone and the inner circumference side and the outer circumference side of the polishing pad can be made larger as they are without lowering the sun gear 16 and the internal gear 15, thereby allowing uniform dressing of the polishing pad.

In the above-described embodiment, since the arm member 44 is turned centering on the rotary shaft 45 and the head part 46 (dressing grind stone) is moved in an arc shape in a radial direction on a polishing pad, and thus there is an advantage that the arm member 44 extending from the rotary shaft 45 can be arranged along next to the lower polishing plate 12, resulting in space-saving. Note that, when there is room for space near the lower polishing plate 12, movement in a straight line may be carried out in a radial direction. In this case, the dressing grind stone can be formed into an H shape having a required width, instead of a deformed H shape.

Furthermore, the spherical seat parts 48 and 49 and the airbag structure are used in order to ensure high performance, but the first dressing grind stone 51 and the second dressing grind stone 52 may be provided by being directly fixed to the supporting member.

What is claimed is:

1. A dressing apparatus for a polishing pad of a double-side polishing apparatus for dressing an upper polishing pad on a ring-shaped upper polishing plate and a lower polishing pad on a ring-shaped lower polishing plate, the double-side polishing apparatus including:

the ring-shaped lower polishing plate having the lower polishing pad fixed on an upper surface and rotatably centered on a first rotary shaft;

the ring-shaped upper polishing plate having the upper polishing pad fixed on a lower surface and being vertically moveable above the ring-shaped lower polishing plate and rotatably centered on a second rotary shaft;

a sun gear disposed at a center of the ring-shaped lower polishing plate;

an internal gear disposed surrounding the ring-shaped lower polishing plate;

a carrier that is disposed between the ring-shaped lower polishing plate and the ring-shaped upper polishing plate, the carrier having a through-hole for holding a work and revolving around the sun gear and rotating on an axis while meshing with the sun gear and the internal gear;

the dressing apparatus comprising:

an arm member provided so as to enter between the ring-shaped upper polishing plate and the ring-shaped lower polishing plate and capable of swinging in an arc shape centering on a third rotary shaft;

a support provided at a tip part of the arm member;

a first dressing grind stone and a second dressing grind stone provided on an upper surface side and a lower surface side of the support, respectively, and the first dressing grind stone and the second dressing grind stone moving in a radial direction of the ring-shaped upper polishing plate and the ring-shaped lower polishing plate while abutting a corresponding upper polishing pad surface and a lower polishing pad surface as a result of the arm member swinging in an arc shape, to thereby grind the corresponding upper polishing pad and the lower polishing pad, wherein each of the first and second dressing grind stones comprises:

an inner side region portion positioned on an inner edge side of the ring-shaped upper polishing plate and the ring-shaped lower polishing plate when moving in an inner edge direction of the ring-shaped upper polishing plate and the ring-shaped lower polishing plate;

an outer side region portion positioned on an outer edge side of the ring-shaped upper polishing plate and the ring-shaped lower polishing plate when moving in an outer edge direction of the ring-shaped upper polishing plate and the ring-shaped lower polishing plate; and an intermediate region portion which is positioned between the inner side region portion and the outer side region portion, wherein a length of each of the inner side region portion and the outer side region portion extending in a circumferential direction of the ring-shaped upper polishing plate and the ring-shaped lower polishing plate is longer than a length of the intermediate region portion extending in the circumferential direction of the ring-shaped upper polishing plate and the ring-shaped lower polishing plate, and wherein the inner side region portion of each of the first grinding stone and the second dressing grind stone comprises a shape that follows an inner edge of the ring-shaped upper and lower polishing plates, and the outer side region portion comprises a shape that follows an outer edge of the ring-shaped upper polishing plate and the ring-shaped lower polishing plate.

2. The dressing apparatus for a polishing pad of a double-side polishing apparatus according to claim 1, wherein the support is provided with a nozzle unit that jets cleaning water to the respective polishing pads of the ring-shaped upper polishing plate and the ring-shaped lower polishing plate.

3. The dressing apparatus for a polishing pad of a double-side polishing apparatus according to claim 2, wherein a spherical seat part is provided on an upper surface side and a lower surface side of the support, and each of the first and second dressing grind stones is tiltably supported by the spherical seat part.

4. The dressing apparatus for a polishing pad of a double-side polishing apparatus according to claim 3, wherein first and second airbags are provided between the first and second dressing grind stones and the support, respectively, and compressed air is supplied to the first and second airbags, to thereby give pressing force by air onto the first and second dressing grind stones.

5. The dressing apparatus for a polishing pad of a double-side polishing apparatus according to claim 4, wherein air suppliers independently supplying compressed air to each of the first and second airbags are provided.

6. The dressing apparatus for a polishing pad of a double-side polishing apparatus according to claim 5, wherein each of the first and second dressing grind stones is guided in a direction contacting or separating the support via a guide shaft inserted into the support.

7. The dressing apparatus for a polishing pad of a double-side polishing apparatus according to claims 1, wherein the inner side region portion, the intermediate region portion and the outer side region portion of each of the first and second dressing grind stones form an H shape.

8. The dressing apparatus for a polishing pad of a double-side polishing apparatus according to claim 1, wherein a spherical seat part is provided on an upper surface side and a lower surface side of the support, and each of the first and second dressing grind stones is tiltably supported by the spherical seat part.

9. The dressing apparatus for a polishing pad of a double-side polishing apparatus according to claim 8, wherein first and second airbags are provided between the first and second dressing grind stones and the support, respectively, and compressed air is supplied to the first and second airbags, to thereby give pressing force by air onto the first and second dressing grind stones.

10. The dressing apparatus for a polishing pad of a double-side polishing apparatus according to claim 9, wherein air suppliers independently supplying compressed air to each of the first and second airbags are provided.

11. The dressing apparatus for a polishing pad of a double-side polishing apparatus according to claim 10, wherein each of the first and second dressing grind stones is guided in a direction contacting or separating the support via a guide shaft inserted into the support.

12. A dressing method for a polishing pad of a double-side polishing apparatus, by using a dressing apparatus for dressing an upper polishing pad on a ring-shaped upper polishing plate and a lower polishing pad on a ring-shaped lower polishing plate, the double-side polishing apparatus including:

the ring-shaped lower polishing plate having the lower polishing pad fixed on an upper surface and rotatably centered on a first rotary shaft;

the ring-shaped upper polishing plate having the upper polishing pad fixed on a lower surface and being vertically movable above the lower polishing plate and rotatably centered on a second rotary shaft;

a sun gear disposed at a center of the ring-shaped lower polishing plate;

an internal gear disposed surrounding the ring-shaped lower polishing plate;

a carrier that is disposed between the ring-shaped lower polishing plate and the ring-shaped upper polishing plate, the carrier having a through-hole for holding a work and revolving around the sun gear and rotates on an axis while meshing with the sun gear and the internal gear;

the dressing apparatus comprising:

an arm member provided so as to enter between the ring-shaped upper polishing plate and the ring-shaped lower polishing plate and capable of swinging in an arc shape centering on a third rotary shaft;

a support provided at a tip part of the arm member;

a first dressing grind stone and a second dressing grind stone provided on an upper surface side and a lower surface side of the support, respectively, and the first dressing grind stone and the second dressing grind stone moving in a radial direction of the ring-shaped upper polishing plate and the ring-shaped lower polishing plate while abutting on a corresponding upper polishing pad surface and lower polishing pad surface, as a result of the arm member swinging in an arc shape, to thereby grind the upper polishing pad and the lower polishing pad, respectively, wherein each of the first and second dressing grind stones comprises:

an inner side region portion positioned on an inner edge side of the ring-shaped upper polishing plate and the ring-shaped lower polishing plate when moving in an inner edge direction of the ring-shaped upper polishing plate and the ring-shaped lower polishing plate;

an outer side region portion positioned on an outer edge side of the ring-shaped upper polishing plate and the ring-shaped lower polishing plate when moving in an outer edge direction of the ring-shaped upper polishing plate and the ring-shaped lower polishing plate; and an intermediate region portion which is positioned between the inner side region portion and the outer side region portion, wherein a length of each of the inner side region portion and the outer side region portion extending in a circumferential direction of the ring-shaped upper polishing plate and the ring-shaped lower polishing plate is longer than a length of the intermediate region portion extending in the circumferential direction of the ring-shaped upper polishing plate and the ring-shaped lower polishing plate, and wherein each of the inner side region portions of the first dressing grind stone and second dressing grind stone comprises a shape that follows an inner edge of the ring-shaped upper polishing plate and the ring-shaped lower polishing plate, and the outer side region portions comprise a shape that follows an outer edge of the ring-shaped upper polishing plate and the ring-shaped lower polishing plate, said method comprising:

rotating the ring-shaped upper polishing plate and the ring-shaped lower polishing plate of a double-side polishing apparatus;

causing the arm member to enter between the ring-shaped upper polishing plate and the ring-shaped lower polishing plate and causing the arm member to swing in an arc shape to thereby move the first and second dressing grind stones in a radial direction of the upper and lower polishing plates; and grinding the polishing pad so as to give approximately uniform thickness, including an inner edge side and an outer edge side of the polishing pad, to thereby perform a dressing operation of the polishing pad.

13. The dressing method for a polishing pad of a double-side polishing apparatus according to claim 12, the method further comprising cleaning the polishing pad by jetting out cleaning water to the polishing pad from the nozzle unit, in parallel with the dressing operation of the polishing pad or after the dressing operation of the polishing pad.

14. The dressing method for a polishing pad of a double-side polishing apparatus according to claim 12, the method further comprising:

removing only one of the plurality of carriers mounted on the double-side polishing apparatus; and moving the first and second dressing grind stones in a radial direction of the upper and lower polishing plates in a region of an exposed polishing pad, to thereby perform the dressing operation of the polishing pad.

15. The dressing method for a polishing pad of a double-side polishing apparatus according to claim 12, wherein a rotation frequency of the ring-shaped upper polishing plate and the ring-shaped lower polishing plate when the first and second dressing grind stones are positioned on a center side of the ring-shaped upper polishing plate and the ring-shaped lower polishing plate is set to be greater than a rotation frequency of the upper and lower polishing plates when the first and second dressing grind stones are positioned on an outer circumference side of the ring-shaped upper polishing plate and the ring-shaped lower polishing plate.

16. The dressing method for a polishing pad of a double-side polishing apparatus according to claim 12, wherein a staying time of the first and second dressing grind stones when the first and second dressing grind stones are positioned on a center side of the ring-shaped upper polishing plate and the ring-shaped lower polishing plate is set to be longer than a staying time of the first and second dressing grind stones when the first and second dressing grind stones are positioned on an outer circumference side of the ring-shaped upper polishing plate and the ring-shaped lower polishing plate.

17. The dressing method for a polishing pad of a double-side polishing apparatus according to claim 12, wherein pressing force onto the polishing pad by the first and second dressing grind stones when the first and second dressing grind stones are positioned on a center side of the ring-shaped upper polishing plate and the ring-shaped lower polishing plate is set to be larger than pressing force onto the polishing pad by the first and second dressing grind stones when the first and second dressing grind stones are positioned on an outer circumference side of the ring-shaped upper polishing plate and the ring-shaped lower polishing plate.

18. The dressing apparatus for a polishing pad of a double-side polishing apparatus according to claim 1, wherein a contact area of the inner side region portion with the polishing pad and a contact area of the outer side region portion with the polishing pad are larger than a contact area of the intermediate side region portion with the polishing pad respectively.

* * * * *